United States Patent [19]

Schröder et al.

[11] Patent Number: 4,810,038

[45] Date of Patent: Mar. 7, 1989

[54] BUNKER FOR SURFACE MINES AND METHOD OF FORMING A STORAGE AREA FOR THE BUNKER

[75] Inventors: Gerd Schröder; Egon Stender, both of Duisburg, Fed. Rep. of Germany

[73] Assignee: Fried. Krupp GmbH, Essen, Fed. Rep. of Germany

[21] Appl. No.: 176,777

[22] Filed: Apr. 1, 1988

[30] Foreign Application Priority Data

Apr. 1, 1987 [DE] Fed. Rep. of Germany ..... 3710854

[51] Int. Cl.[4] ..... B65G 47/18

[52] U.S. Cl. ..... 299/18; 198/311; 198/522

[58] Field of Search ..... 299/10, 18, 64, 95; 414/327, 288; 198/311, 522

[56] References Cited

U.S. PATENT DOCUMENTS

| | | | |
|---|---|---|---|
| 3,315,795 | 4/1967 | Ross et al. | 198/311 |
| 4,350,241 | 9/1982 | Wenzel | 198/311 |
| 4,402,392 | 9/1983 | Fabian et al. | 198/311 |
| 4,408,945 | 10/1983 | Wenzel et al. | 414/325 |

FOREIGN PATENT DOCUMENTS

| | | | |
|---|---|---|---|
| 50577 | 1/1941 | Netherlands | 198/522 |
| 1227188 | 4/1971 | United Kingdom | 198/311 |

*Primary Examiner*—Jerome W. Massie, IV
*Assistant Examiner*—David J. Bagnell
*Attorney, Agent, or Firm*—Spencer & Frank

[57] ABSTRACT

A bunker system for accommodating and further transporting materials from surface mines includes a bunker device being provided adjacent a terrace wall. The bunker device comprises a platform and an endless conveyor for transporting the material; side walls bounding and together surrounding the platform to form, with the platform, an upwardly open storage area for accommodating and holding the materials. A niche, having niche walls, is provided in the terrace wall. Some of the side walls form part of the bunker device and are disposed on the platform adjacent the endless conveyor and some of the side walls are constituted by the niche walls.

20 Claims, 2 Drawing Sheets

BUNKER FOR SURFACE MINES AND METHOD OF FORMING A STORAGE AREA FOR THE BUNKER

BACKGROUND OF THE INVENTION

The present invention relates to a bunker device for receiving and transporting away materials from surface (pen pit) mines or similar depositories. The bunker device is of the type that is arranged at a terrace wall forming a loading ramp and includes a bunker provided with a platform and side walls. The bunker device further has an endless conveyor for transporting away the material received by the bunker.

In surface mines in which ores, coal or other minerals are mined, and which are often referred to as quarries, the mined or blasted-off material is in most cases intermediately stored in bunkers before it is subjected to further comminuting treatment or classification. The conventional intermediate or storage bunkers used for this purpose have stable side walls made of heavy steel structures which must be able to withstand the bulky and often hard material. To be able to charge these bunkers, which is generally performed by heavy-duty trucks or other transporting vehicles and devices, it is known to use the terraced wall formed during mining as the loading ramp to which the bunker is brought closely. If the terraced wall is made of insufficiently solid rock, a special supporting wall must be erected or a special ramp must be provided.

SUMMARY OF THE INVENTION

It is an object of the invention to provide a bunker system of the above-mentioned type which is of simpler and less expensive construction than loading bunkers according to the prior art.

This object and others to become apparent as the specification progresses, are accomplished by the invention, according to which, briefly stated, a bunker system is provided for accommodating and further transporting materials from surface mines. The system includes a bunker device comprising a platform including an endless conveyor for transporting the material and side walls bounding the platform to form an upwardly open storage area for accommodating the materials. A niche having niche walls is provided in the terrace wall. Some of the side walls form part of the bunker device and are disposed on the platform adjacent the endless conveyor, and some of the side walls are constituted by the niche walls.

The invention further includes a method of producing the novel bunker system.

Due to the fact that some (at least half) of the side walls for the bunker are formed by a niche in the terrace wall, the corresponding side walls which would otherwise have to be provided as part of the bunker are eliminated. Thus a considerable amount of wear is eliminated and the weight of the bunker is significantly reduced. The savings in weight facilitate relocation of the bunker device.

The niche in the terrace wall may already exist in the surface mine or may be specially produced. In the latter event, particularly in the case of a terrace wall composed of harder rock, the niche may be obtained by a blasting process. If the material of the terrace wall does not have sufficient strength to form a loading ramp, the walls of the niche may be fortified in a suitable manner, for example, by supported covers, rammed structures or ground reinforcements. The manner of fortification depends on the respective conditions and requirements.

The slope angle of the bunker side walls formed by the niche with respect to the horizontal should not be less than the natural slope angle of the material to be charged. In case the natural slope angle is exceeded, the material forms a natural slope on which the additionally charged material is able to slide down.

DESCRIPTION OF THE PREFERRED EMBODIMENT

Figure 1:
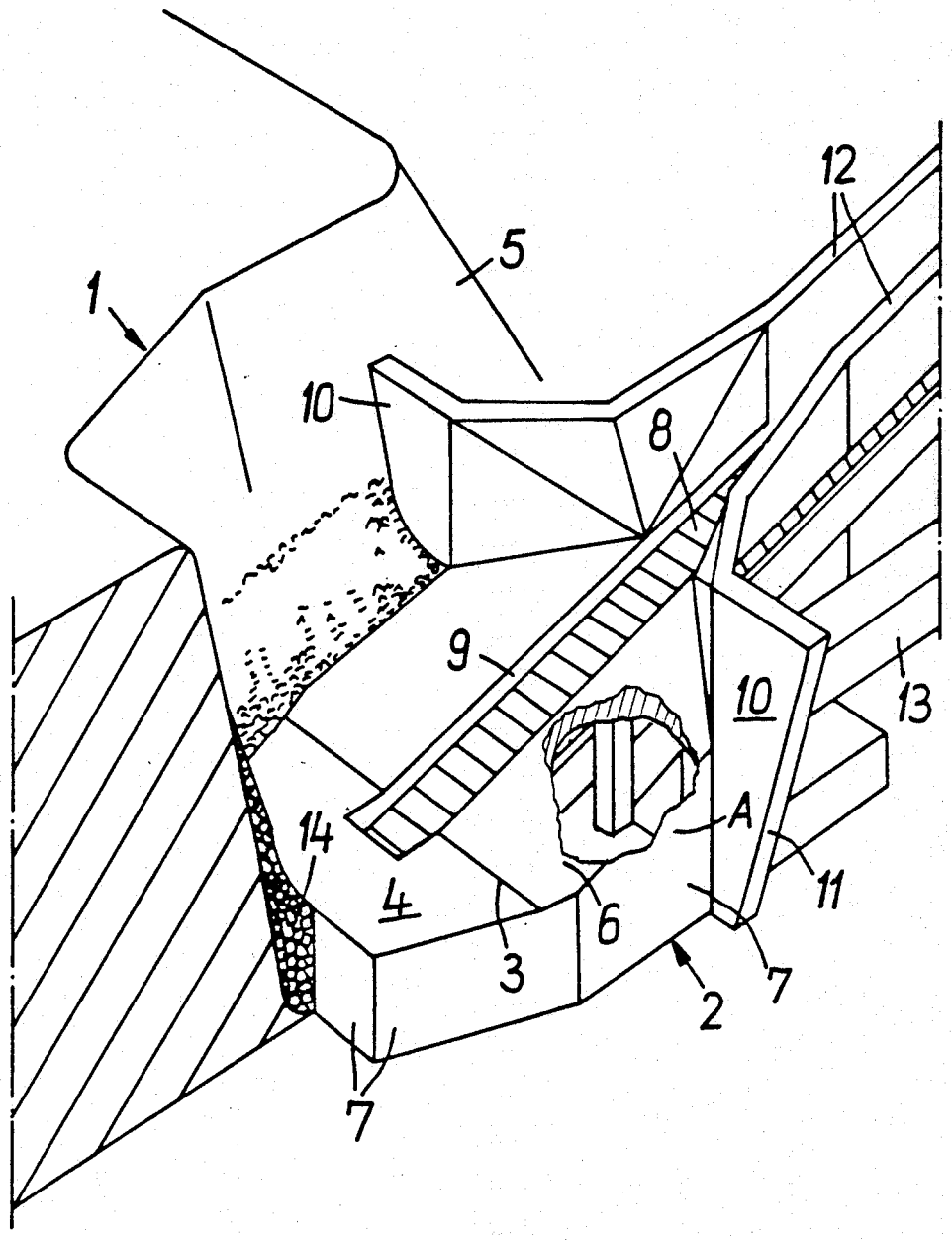
FIG. 1 is a perspective and partially sectional view of a bunker device according to a preferred embodiment of the invention in an uncharged state.

Turning now to FIG. 1, a bunker 2 is disposed in a niche 1, of which only one half is shown. The bunker is supported by the bottom of the niche. The part of niche 1 not illustrated continues symmetrically on the other side of bunker 2. Bunker 2 includes a platform 3 which has a horizontal portion 4 and a portion 6 which ascends toward the opening 5 of niche 1. Platform 3, in the region of niche 1, is provided with vertical protective walls 7 which extend toward the ground and give the bunker 2 the shape of a downwardly open housing. An endless platform conveyor 8 is disposed in the housing, as can be seen through the brokenaway portion A. The platform conveyor 8 is disposed directly below platform 3, covering a slot 9 extending in the ascending portion 6 and projecting into the horizontal portion 4 of platform 3. Platform conveyor 8 and slot 9 are disposed centrally relative to bunker 2 and niche 1 and form part of the vertical plane of symmetry of the entire bunker.

Side walls 10 are arranged on both sides of bunker 2, with respect to its plane of symmetry, and project laterally in the manner of wings beyond vertical protective walls 7. Side walls 10 completely fill the opening 5 of niche 1 with their correspondingly sloped outer edge 11. To adapt themselves to different dimensions of opening 5 and to different slope angles, side walls 10 may be made adjustable in various ways.

In the conveying direction of platform conveyor 8, side walls 10 change to guide walls 12 which laterally delimit platform conveyor 8 outside of niche 1 and outside of bunker 2, where the platform conveyor 8 continues to steadily ascend until it reaches its discharge end (not shown). The discharge end may be provided with a supporting structure 13 connected with bunker 2, particularly if the ascending portion of the conveying path has a substantial length.

In a top plan view, platform 3 has the shape of a nearly regular octagon. The base surface of niche 1 has approximately the same shape as the platform 3 and becomes steadily wider from the base surface toward the top of the niche. The space formed between the vertical side walls 7 and the side walls of niche 1 due to the widening of niche 1, is filled with a gravel-like material 14 as shown in FIG. 1. This will prevent protective walls 7 from adhering to the niche in case fine material cakes on the larger contact areas. Protective walls 7 and side walls 10 also prevent the material from reaching the area below platform 3 so that the interior of the housing of bunker 2 is protected. This housing also accommodates the reversing guide and support for platform conveyor 8 and may also receive other required assemblies which are accessible for operation and maintenance from outside of niche 1.

Figure 2:
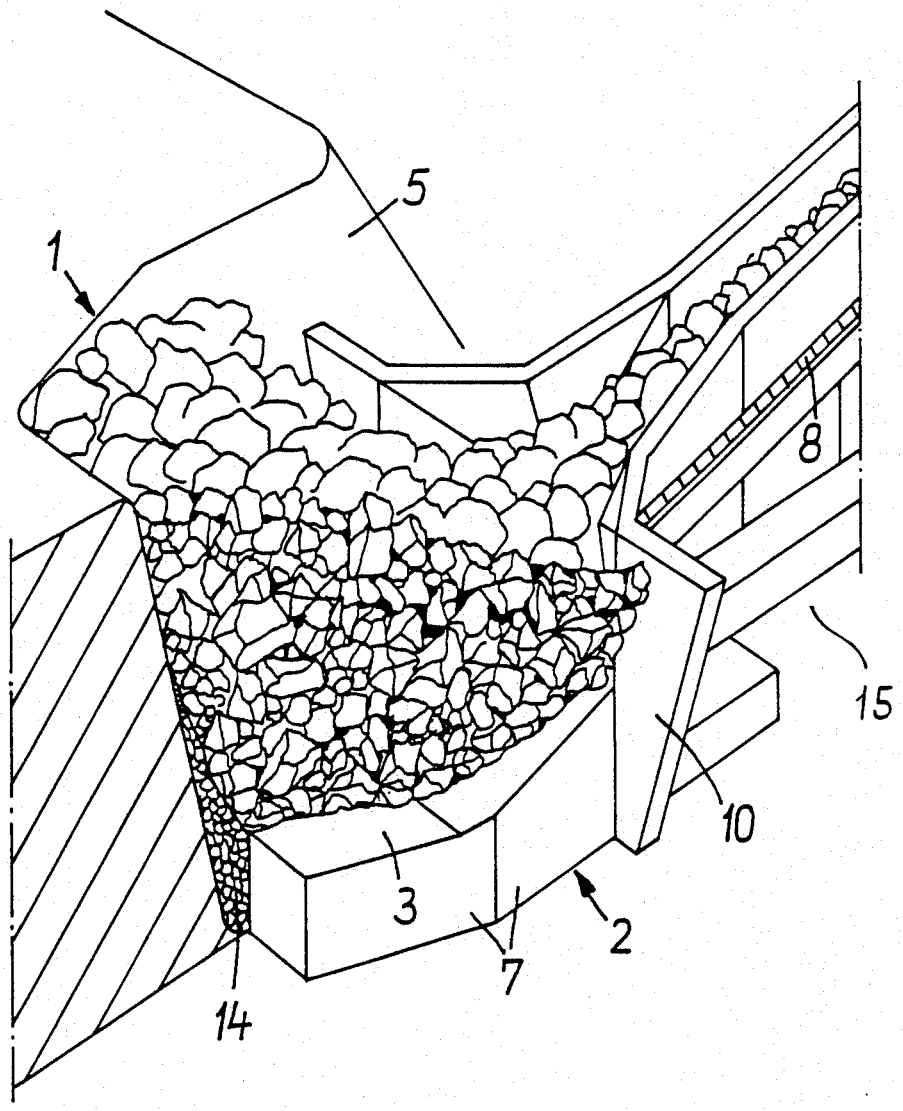
FIG. 2 is a view similar to FIG. 1, showing the bunker device in a charged state.

The transportable portion of the bunker device may be moved in a simple manner in that a transporting vehicle provided with lifting devices, for example a transporting caterpillar, enters into a portal-like opening disposed in the region of the center of gravity of the bunker device. The portal-like opening may be formed, for example, in the supporting structure 13 between bunker 2 and the supporting structure of the discharge end of platform conveyor 8 as indicated by numeral 15 in FIG. 2.

The configuration of the niche is not bound by any defined shape of the terrace wall. The terrace wall may be straight, curved, form a projection or a recess. Also, the niche may be dimensioned in such a way that, if high load performance is required, two or more bunkers can be arranged next to one another in the niche. Moreover, a bunker may also be equipped with a plurality of platform conveyors or other suitable continuous conveyors.

The present disclosure relates to the subject matter disclosed in the Federal Republic of Germany Application No. P 37 10 854.9 filed Apr. 1st, 1987, the entire specification of which is incorporated herein by reference.

What is claimed is:

1. In a bunker system for accommodating and further transporting materials from surface mines, including a bunker device being provided adjacent a terrace wall, said bunker device comprising a platform and an endless conveyor for transporting the material; side walls bounding and together surrounding said platform to form, with said platform, an upwardly open storage area for accommodating and holding the materials; the improvement comprising a niche provided in said terrace wall and having niche walls; further wherein said side walls comprise first and second side walls; said first side walls forming part of said bunker device and being disposed on the platform adjacent the endless conveyor and the second side walls being formed by said niche walls.

2. A bunker system as defined in claim 1, wherein said platform has a generally horizontal outline; said niche flaring upwardly and having a horizontal outline generally corresponding to the outline of said platform.

3. A bunker system as defined in claim 1, wherein the first side walls converge toward the endless conveyor in the conveying direction and thereafter extend substantially parallel therewith to form vertical guide walls laterally delimiting the endless conveyor.

4. A bunker system as defined in claim 1, wherein the bunker device is provided with a portal-like opening accessible from outside of the niche for receiving a transporting vehicle.

5. A bunker system as defined in claim 1, wherein said niche has a front opening and the first side walls close said front opening.

6. A bunker system as defined in claim 5, wherein the first side walls are arranged symmetrically on either side of the endless conveyor.

7. A bunker system as defined in claim 1, wherein the platform is substantially in the shape of a regular polygon.

8. A bunker system as defined in claim 7, wherein said polygon is an octagon.

9. A bunker device as defined in claim 1, wherein the platform forms a cover face of a downwardly open housing of the bunker device; said housing having side walls extending downwardly from said cover face.

10. A bunker system as defined in claim 9, wherein the side walls of the housing extend vertically downward from said cover face.

11. A bunker system as defined in claim 9, wherein a space between the niche and the protective side walls of the housing being filled with gravel to prevent the protective side wall from adhering to the niche.

12. A bunker system as defined in claim 9, further comprising means defining a slot in said platform; said endless conveyor being disposed in said slot, below a top surface of said platform.

13. A bunker system as defined in claim 12, wherein the endless conveyor is a platform conveyor which ascends in the conveying direction.

14. A bunker system as defined in claim 13, wherein the portion of the platform having the slot therein ascends in the same direction as the platform conveyor.

15. A bunker device for use in a surface mine, comprising: a platform including an endless conveyor and solely two side walls disposed on and supported by said platform at either side of said endless conveyor; said endless conveyor having a conveying direction extending from said platform to a discharge end, wherein said two side walls are disposed on said platform such that said side walls are transverse to said conveying direction and said platform extends from said side walls in a direction opposite said conveying direction; said platform being adapted to be placed within a niche in a terrace wall of said surface mine, such that said niche and said side walls form a receiving and storage area.

16. A bunker device as defined in claim 15, wherein said two side walls are arranged symmetrically with respect to said endless conveyor.

17. A bunker device as defined in claim 15, wherein the two side walls disposed on the platform converge toward the endless conveyor in the conveying direction and thereafter extend substantially parallel therewith to form vertical guide walls laterally delimiting the endless conveyor.

18. A method of producing a receiving and storage area for a bunker device, said bunker device being provided adjacent a terrace wall and having a platform with side walls disposed on the platform and an endless conveyor for transporting material from the storage area, including:

(a) forming a niche in the terrace wall, said niche having niche walls, a top opening and a front opening, (b) placing the platform within the niche, and (c) closing the front opening of the niche with said side walls disposed on the platform, such that the niche walls, the platform and the side walls form said receiving and storage area for the bunker device.

19. A method of producing a receiving and storage area for a bunker device as defined in claim 18, wherein the step of forming the niche includes blasting.

20. A method of producing a receiving and storage area for a bunker device as defined in claim 18 further including the steps of providing a space between the platform and the niche, and filling said space with gravel.

* * * * *